US006910912B2

(12) United States Patent
Hung

(10) Patent No.: US 6,910,912 B2
(45) Date of Patent: Jun. 28, 2005

(54) WIRE CONNECTOR

(76) Inventor: Pao-Tien Hung, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/677,795

(22) Filed: Sep. 30, 2003

(65) Prior Publication Data

US 2005/0070147 A1 Mar. 31, 2005

(51) Int. Cl.[7] ..... H01R 4/24

(52) U.S. Cl. ..... 439/404; 439/701

(58) Field of Search ..... 439/352, 701, 439/540.1, 719, 717, 395–422; 29/866, 749; 361/790, 730

(56) References Cited

U.S. PATENT DOCUMENTS 5,429,530 A * 7/1995 Zander et al. ..... 439/622
5,713,756 A * 2/1998 Abe ..... 439/404
6,163,958 A * 12/2000 Suzuki ..... 29/866

* cited by examiner

*Primary Examiner*—Alex Gilman
(74) *Attorney, Agent, or Firm*—Alan D. Kamrath; Nikolai & Mersereau, P.A.

(57) ABSTRACT

A wire connector includes a main body, an upper cover, an upper cutter, a lower cover, and a lower cutter. Thus, the oblique jaw portions of the pliers are closely urged on the oblique faces of the action portions of the upper cover and the lower cover, so that the upper cover and the lower cover are pressed by the pair of pliers to move into the receiving chamber of the main body smoothly and conveniently without incurring deflection.

14 Claims, 6 Drawing Sheets

WIRE CONNECTOR

BACKGROUND OF THE INVENTION

1. Field of the Invention

The present invention relates to a wire connector for connecting an electric wire, and more particularly to a wire connector that facilitates the user's operation.

2. Description of the Related Art

A conventional wire connector 1 in accordance with the prior art shown in FIGS. 1 and 2 comprises a main body 11, and a cover 12 movably mounted on the main body 1. The main body 11 has an outer wall formed with a protruding receiving block 111 connected to the inside of the main body 11 for passage of a plurality of electric wires A. The cover 12 is provided with a cutter 121 aligning with the electric wires A. In operation, the jaws B1 of a pair of pliers B are pressed on the cover 12 and the main body 11 to move the cover 12 into the main body 11, so that the cutter 121 of the cover 12 will pierce the outer layers of the electric wires A, thereby conducting the cores A1 of all of the electric wires A.

However, each of the jaws B1 of the pliers B is disposed at an oblique state, and the surface of each of the cover 12 and the main body 11 is disposed at a horizontal state, so that each of the jaws B1 of the pliers B applies an oblique pressing force on the cover 12 and the main body 11, thereby easily incurring deflection. Thus, the cover 12 cannot be moved into the main body 11 easily and conveniently, thereby causing inconvenience to the user.

SUMMARY OF THE INVENTION

The primary objective of the present invention is to provide a wire connector for connecting an electric wire.

Another objective of the present invention is to provide a wire connector, wherein the oblique jaw portions of the pliers are closely urged on the oblique faces of the action portions of the upper cover and the lower cover, so that the upper cover and the lower cover are pressed by the pair of pliers to move into the receiving chamber of the main body smoothly and conveniently without incurring deflection.

A further objective of the present invention is to provide a wire connector, wherein the cutting slots of the upper cutter and the cutting slots of the lower cutter co-operate with each other to pierce the outer layers of the electric wires, thereby conducting the cores of all of the electric wires exactly.

A further objective of the present invention is to provide a wire connector, wherein the locking hooks of the guide plates of the upper cover and the lower cover are locked in the respective insertion recesses of the receiving chamber of the main body, so that the upper cover and the lower cover are locked in the receiving chamber of the main body rigidly and stably.

In accordance with the present invention, there is provided a wire connector, comprising a main body, an upper cover, an upper cutter, a lower cover, and a lower cutter, wherein:

the main body has an inner wall formed with a receiving chamber;

the upper cover is mounted in an upper portion of the receiving chamber of the main body and has an inside formed with a channel;

the upper cutter is inserted into the channel of the upper cover and has a surface formed with a plurality of equally spaced cutting slots;

the lower cover is mounted in a lower portion of the receiving chamber of the main body and has an inside formed with a channel; and the lower cutter is inserted into the channel of the lower cover and has a surface formed with a plurality of equally spaced cutting slots.

Further benefits and advantages of the present invention will become apparent after a careful reading of the detailed description with appropriate reference to the accompanying drawings.

DETAILED DESCRIPTION OF THE INVENTION

Figure 1:
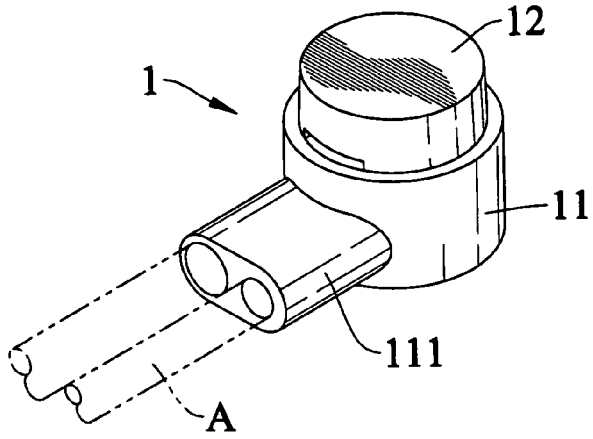
FIG. 1 is a perspective view of a conventional wire connector in accordance with the prior art.
Figure 2:
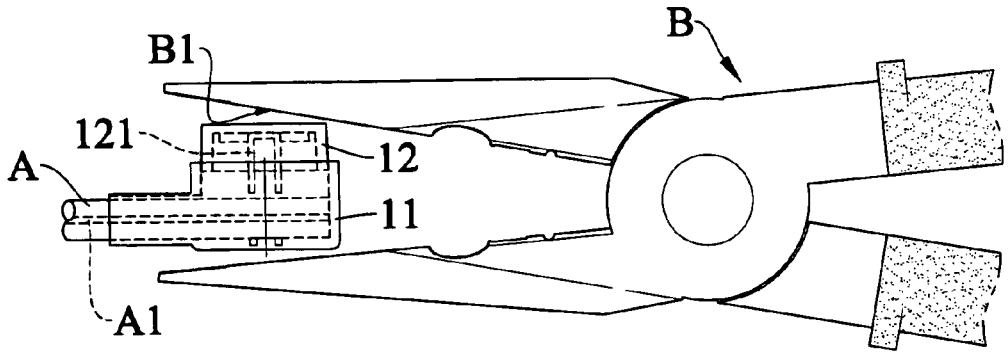
FIG. 2 is a schematic plan operational view of the conventional wire connector in accordance with the prior art.
Figure 3:
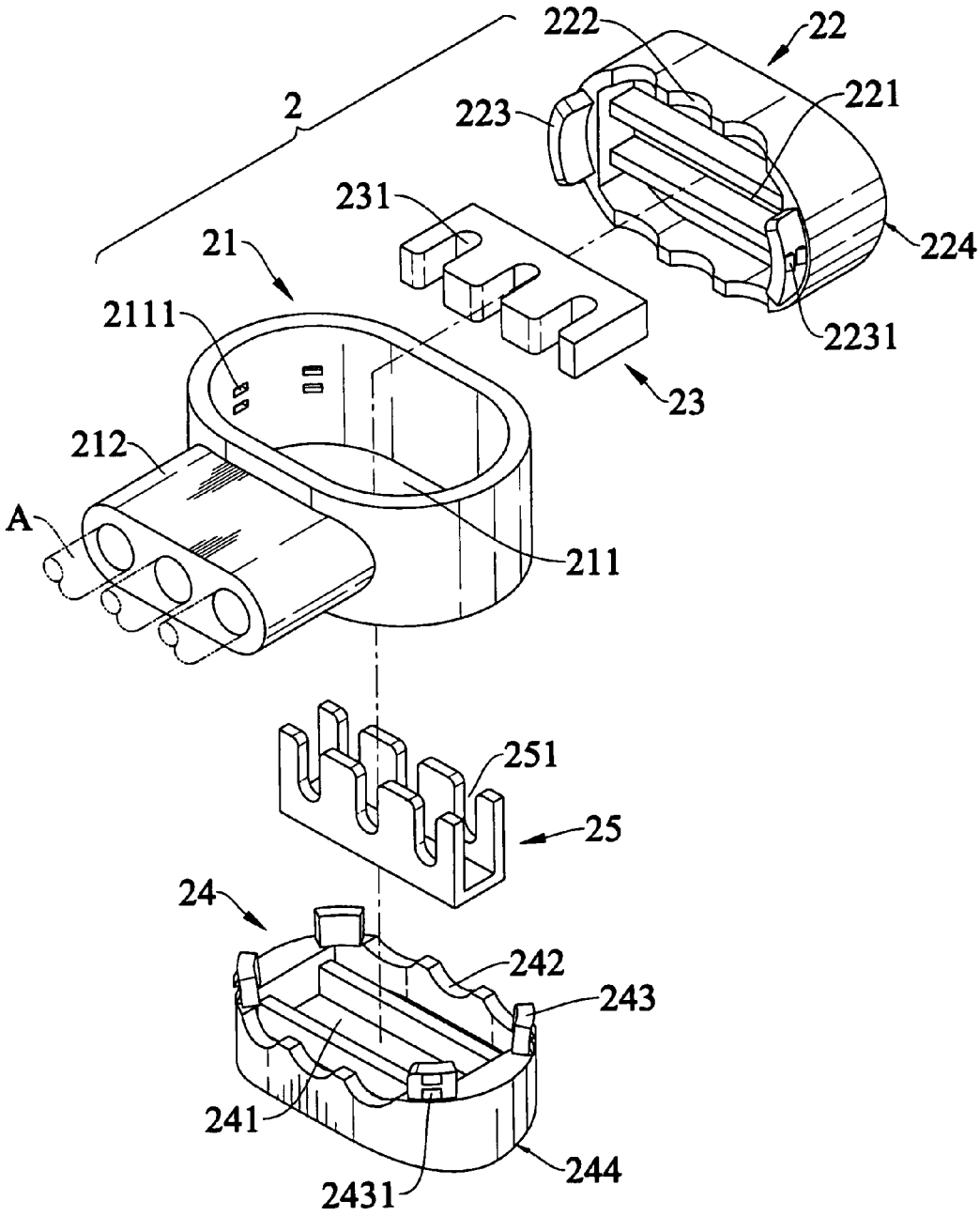
FIG. 3 is an exploded perspective view of a wire connector in accordance with the preferred embodiment of the present invention.
Figure 4:
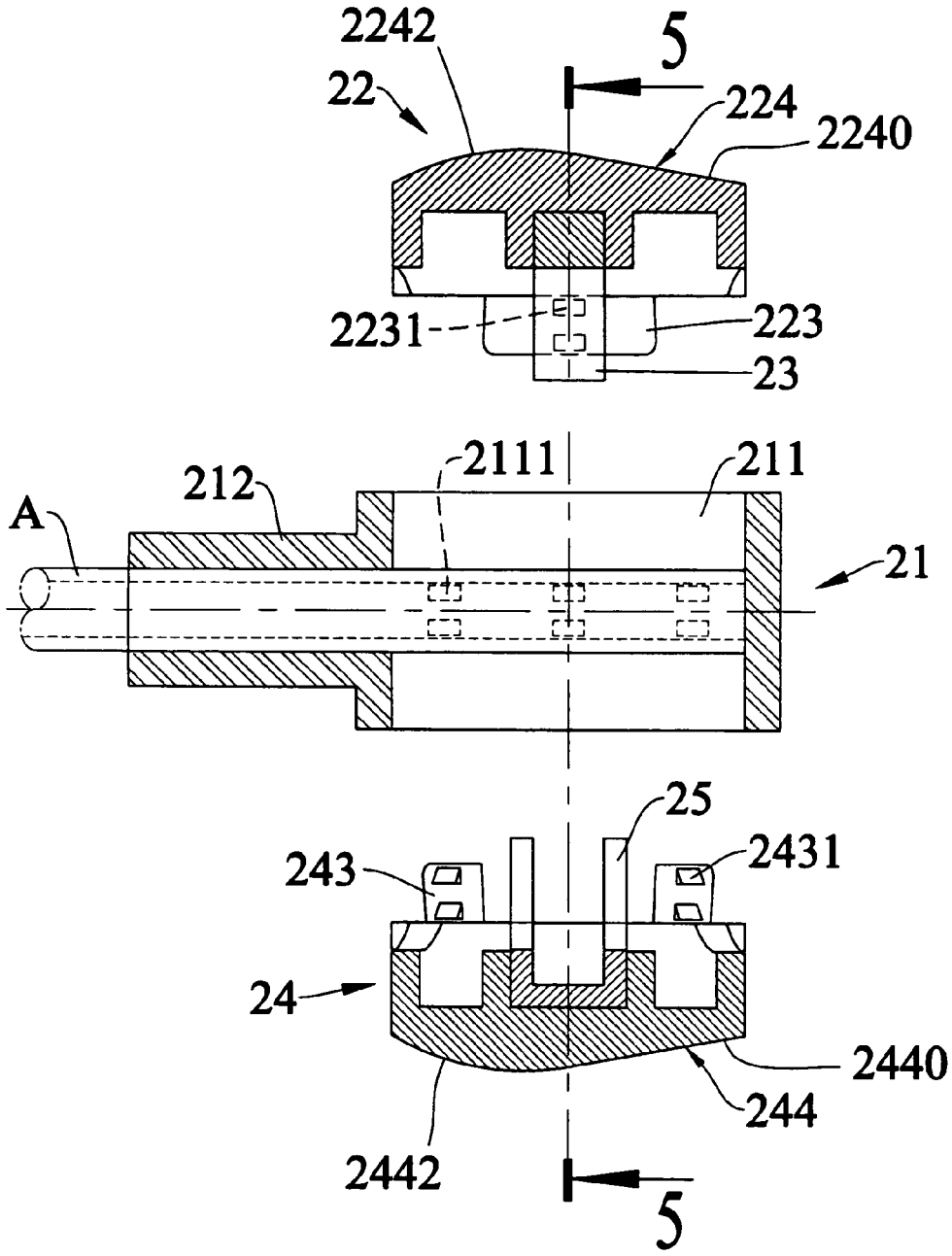
FIG. 4 is a plan exploded cross-sectional view of the wire connector in accordance with the preferred embodiment of the present invention.
Figure 5:
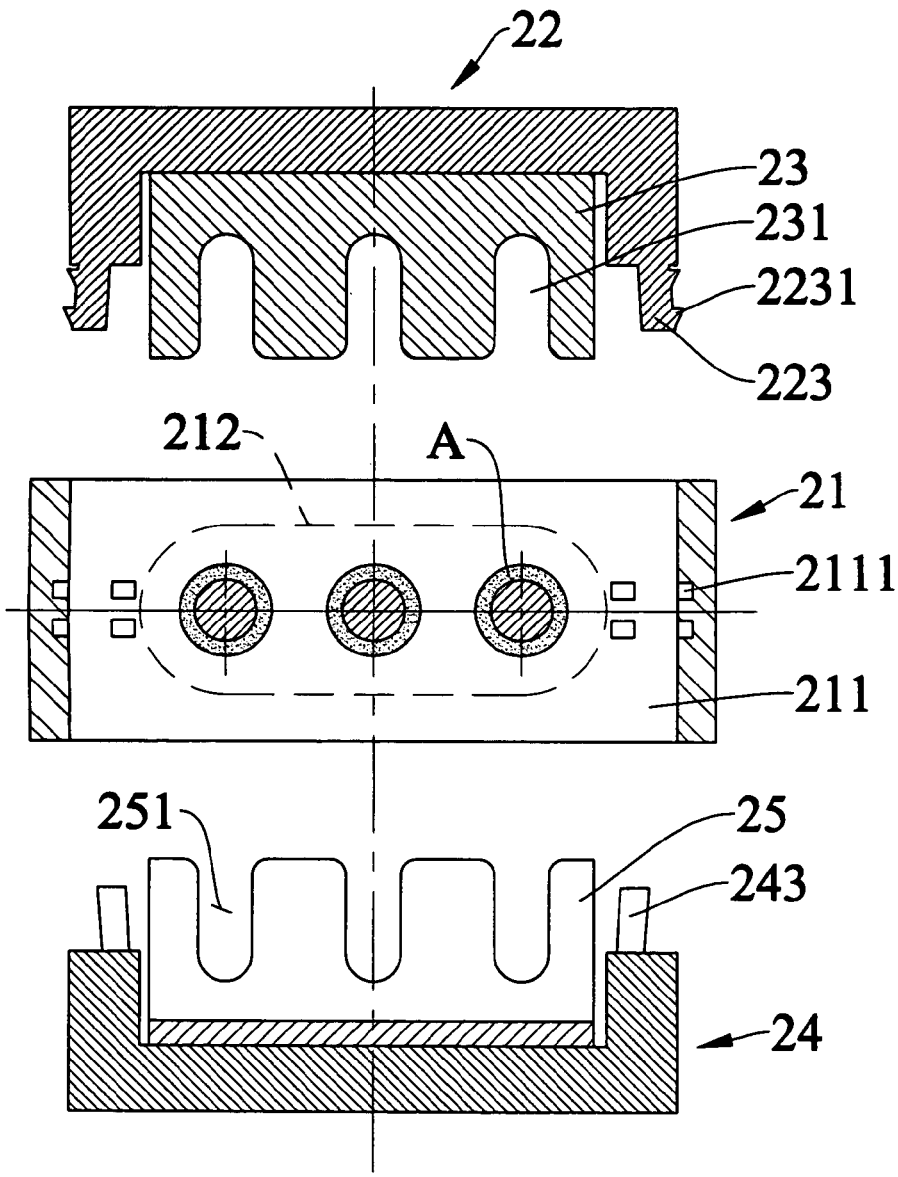
FIG. 5 is a plan cross-sectional view of the wire connector taken along line 5—5 as shown in FIG. 4.

Referring to the drawings and initially to FIGS. 3–5, a wire connector 2 in accordance with the preferred embodiment of the present invention comprises a main body 21, an upper cover 22, an upper cutter 23, a lower cover 24, and a lower cutter 25.

The main body 21 has an inner wall formed with an oblong receiving chamber 211. The receiving chamber 211 of the main body 21 has a periphery formed with a plurality of insertion recesses 2111. The main body 21 has an outer wall formed with a protruding receiving block 212 connected to the receiving chamber 211 of the main body 21 for passage of a plurality of electric wires A.

Figure 6:
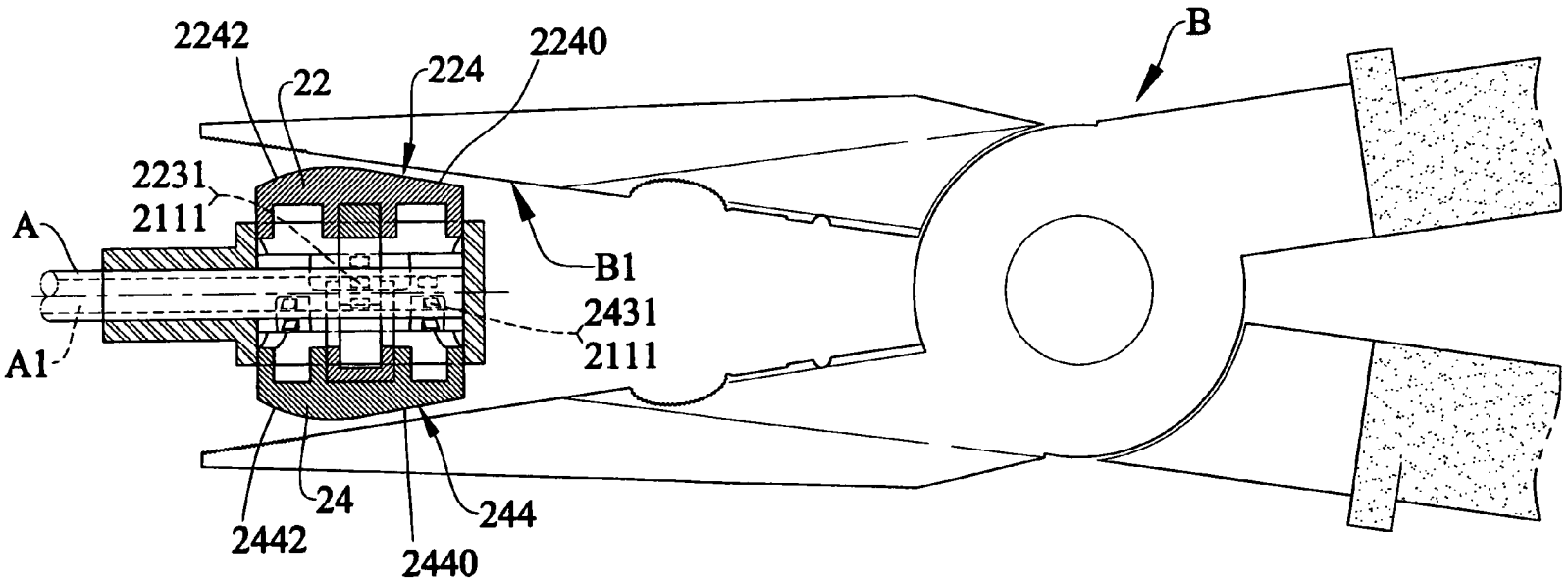
FIG. 6 is a schematic plan cross-sectional operational view of the wire connector in accordance with the preferred embodiment of the present invention.

The upper cover 22 is mounted in an upper portion of the receiving chamber 211 of the main body 21 and has an inside formed with a channel 221. The upper cover 22 has two side walls each having a lower portion formed with a plurality of arc-shaped grooves 222. The upper cover 22 has two ends each having a lower portion formed with a guide plate 223 having an outer wall formed with two locking hooks 2231 each corresponding to a respective one of the insertion recesses 2111 of the receiving chamber 211 of the main body 21. The upper cover 22 has a top formed with an action portion 224 having a first section formed with an oblique face 2240 mating with the inclined angle of one jaw portion B1 of a pair of pliers B as shown in FIG. 6, and a second section formed with an arcuate face 2242 gradually extended downward.

The upper cutter 23 is a single-plate conductive plate and is inserted into the channel 221 of the upper cover 22. The upper cutter 23 has a surface formed with a plurality of equally spaced cutting slots 231 for mounting the respective electric wires A.

The lower cover 24 is mounted in a lower portion of the receiving chamber 211 of the main body 21 and has an inside formed with a channel 241. The lower cover 24 has two side walls each having an upper portion formed with a plurality of arc-shaped grooves 242. The lower cover 24 has two ends each having an upper portion formed with a guide plate 243 having an outer wall formed with two locking hooks 2431 each corresponding to a respective one of the insertion recesses 2111 of the receiving chamber 211 of the main body 21. The lower cover 24 has a bottom formed with an action portion 244 having a first section formed with an oblique face 2440 mating with the inclined angle of the other jaw portion B1 of the pair of pliers B as shown in FIG. 6, and a second section formed with an arcuate face 2442 gradually extended upward.

The lower cutter 25 is a substantially U-shaped dual-plate conductive plate and is inserted into the channel 241 of the lower cover 24. The lower cutter 25 has a surface forted with a plurality of equally spaced cutting slots 251 for mounting the respective electric wires A.

In operation, referring to FIGS. 3–8, the electric wires A in the receiving block 212 are extended into the receiving chamber 211 of the main body 21 as shown in FIG. 4. Then, the upper cutter 23 is inserted into the channel 221 of the upper cover 22, and the lower cutter 25 is inserted into the channel 241 of the lower cover 24 as shown in FIG. 5. Then, the upper cover 22 is mounted in the upper portion of the receiving chamber 211 of the main body 21, with the guide plate 223 of the upper cover 22 being rested on a wall of the receiving chamber 211 of the main body 21, and the lower cover 24 is mounted in the lower portion of the receiving chamber 211 of the main body 21, with the guide plate 243 of the lower cover 24 being rested on the wall of the receiving chamber 211 of the main body 21.

Then, as shown in FIG. 6, one jaw portion B1 of the pair of pliers B is closely urged on the oblique face 2240 of the action portion 224 of the upper cover 22, and the other one jaw portion B1 of the pair of pliers B is closely urged on the oblique face 2440 of the action portion 244 of the lower cover 24, so that the upper cover 22 and the lower cover 24 are pressed by the pair of pliers B to move into the receiving chamber 211 of the main body 21 smoothly and conveniently without incurring deflection. At this time, a first one of the two locking hooks 2231 of the guide plate 223 of the upper cover 22 is locked in the respective insertion recess 2111 of the receiving chamber 211 of the main body 21, so that the upper cover 22 is locked in the receiving chamber 211 of the main body 21 temporarily. In addition, a first one of the two locking hooks 2431 of the guide plate 243 of the lower cover 24 is locked in the respective insertion recess 2111 of the receiving chamber 211 of the main boxy 21, so that the lower cover 24 is locked in the receiving chamber 211 of the main body 21 temporarily.

Figure 7:
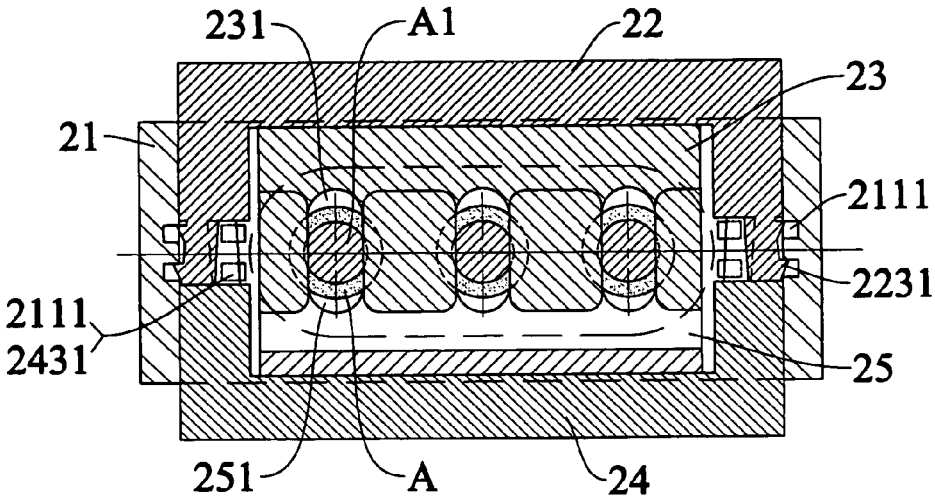
FIG. 7 is a plan assembly view of the wire connector as shown in FIG. 5.
Figure 8:
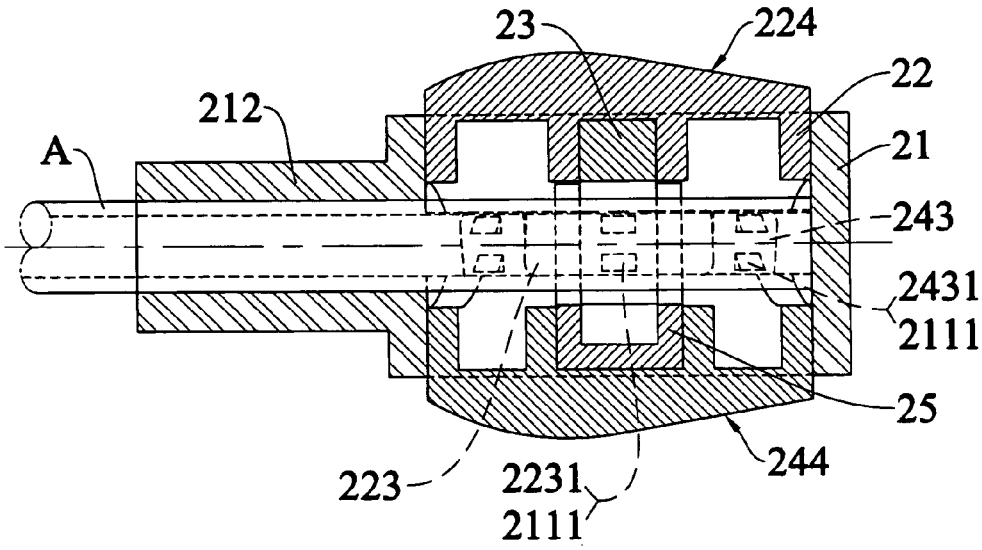
FIG. 8 is a plan assembly view of the wire connector as shown in FIG. 4.

When the upper cover 22 and the lower cover 24 are successively pressed by the pair of pliers B to further move into the receiving chamber 211 of the m body 21, the cutting slots 231 of the upper cutter 23 and the cutting slots 251 of the lower cutter 25 will pierce the outer layers of the respective electric wires A, thereby conducting the cores A1 of all of the electric wires A as shown in FIG. 6. At this time, a second one of the two locking hooks 2231 of the guide plate 223 of the upper cover 22 is locked in the respective insertion recess 2111 of the receiving chamber 211 of the main body 21, so that the upper cover 22 is locked in the receiving chamber 211 of the main body 21 rigidly and stably as shown in FIGS. 7 and 8. In addition, a second one of the two locking hooks 2431 of the guide plate 243 of the lower cover 24 is locked in the respective insertion recess 2111 of the receiving chamber 211 of the main body 21, so that the lower cover 24 is locked in the receiving chamber 211 of the main body 21 rigidly and stably as shown in FIGS. 7 and 8.

Accordingly, the oblique jaw portions B1 of the pair of pliers B are closely urged on the oblique faces 2240 and 2440 of the action portions 224 and 224 of the upper cover 22 and the lower cover 24, so that the upper cover 22 and the lower cover 24 are pressed by the pair of pliers B to move into the receiving chamber 211 of the main body 21 smoothly and conveniently without incurring deflection. In addition, the cutting slots 231 of the upper cutter 23 and the cutting slots 251 of the lower cutter 25 cooperate with each other to pierce the outer layers of the electric wires A, thereby conducting the cores A1 of all of the electric wires A exactly. Further, the locking hooks 2231 and 2431 of the guide plates 223 and 243 of the upper cover 22 and the lower cover 24 are locked in the respective insertion recesses 2111 of the receiving chamber 211 of the main body 21, so that the upper cover 22 and the lower cover 24 are locked in the receiving chamber 211 of the main body 21 rigidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wire connector, comprising a main body, an upper cover, an upper cutter, a lower cover, and a lower cutter, wherein:

the main body has an inner wall formed with a receiving chamber;

the receiving chamber of the main body has an oblong shape;

the upper cover is mounted in an upper portion of the receiving chamber of the main body and has an inside formed with a channel;

the upper cutter is inserted into the channel of the upper cover and has a surface formed with a plurality of equally spaced cutting slots;

the lower cover is mounted in a lower portion of the receiving chamber of the main body and has an inside formed with a channel; and the lower cutter is inserted into the channel of the lower cover and has a surface formed with a plurality of equally spaced cutting slots.

2. The wire connector in accordance with claim 1, wherein the upper cover has two side walls each having a lower portion formed with a plurality of arc-shaped grooves.

3. The wire connector in accordance with claim 1, wherein the upper cover has a top formed with an action portion having a first section formed with an oblique face and a second section formed with an arcuate face.

4. The wire connector in accordance with claim 1, wherein the upper cutter is a single-plate conductive plate.

5. The wire connector in accordance with claim 1, wherein the lower cover has two side walls each having an upper portion formed with a plurality of arc-shaped grooves.

6. The wire connector in accordance with claim 1, wherein the lower cover has a bottom formed with an action portion having a first section formed with an oblique face and a second section formed with an arcuate face.

7. The wire connector in accordance with claim 1, wherein the lower cutter is substantially U-shaped.

8. The wire connector in accordance with claim 1, wherein the lower cutter is a dual-plate conductive plate.

9. The wire connector in accordance with claim 1, wherein the main body has an outer wall formed with a protruding receiving block connected to the receiving chamber of the main body for passage of a plurality of electric wires.

10. The wire connector in accordance with claim 1, wherein the receiving chamber of the main body has a periphery formed with a plurality of insertion recesses.

11. The wire connector in accordance with claim 10, wherein the upper cover has two ends each having a lower portion formed with a guide plate having an outer wall formed with two locking hooks each locked in a respective one of the insertion recesses of the receiving chamber of the main body.

12. The wire connector in accordance with claim 11, wherein the guide plate of the upper cover is rested on a wall of the receiving chamber of the main body.

13. The wire connector in accordance with claim 10, wherein the lower cover has two ends each having an upper portion formed with a guide plate having an outer wall formed with two locking hooks each locked in a respective one of the insertion recesses of the receiving chamber of the main body.

14. The wire connector in accordance with claim 13, wherein the guide plate of the lower cover is rested on a wall of the receiving chamber of the main body.

* * * * *